US006799491B2

(12) United States Patent
Crowley

(10) Patent No.: US 6,799,491 B2
(45) Date of Patent: Oct. 5, 2004

(54) JAR OPENING AIDE WITH ADJUSTMENT FEATURE

(76) Inventor: Nicole Elizabeth Crowley, 6 Rosemont Ct., Greenlawn, NY (US) 11740

( * ) Notice: Subject to any disclaimer, the term of this patent is extended or adjusted under 35 U.S.C. 154(b) by 23 days.

(21) Appl. No.: 10/408,342

(22) Filed: Apr. 7, 2003

(65) Prior Publication Data

US 2004/0011160 A1 Jan. 22, 2004

(51) Int. Cl.[7] ..... B67B 7/16
(52) U.S. Cl. ..... 81/3.55; 81/3.56
(58) Field of Search ..... 81/355, 3.56, 3.57

(56) References Cited

U.S. PATENT DOCUMENTS 55,878 A * 6/1866 Livermore ..... 81/3.57
2,431,833 A * 12/1947 Simpson ..... 81/3.44
4,881,432 A 11/1989 Olorenshaw et al.
5,222,265 A 6/1993 Hermansson
5,295,419 A 3/1994 Denning
6,035,508 A 3/2000 Smith
6,105,468 A 8/2000 Fohrman et al.
6,378,398 B2 * 4/2002 Brix-Hansen ..... 81/3.57

* cited by examiner

*Primary Examiner*—Derris H. Banks
*Assistant Examiner*—Jamila O Williams
(74) *Attorney, Agent, or Firm*—Island Patent; F. Scott Tierno

(57) ABSTRACT

A jar opening aide employs a lever action for lifting a lower peripheral lip portion of a jar sealing lid, defeating the sealing of an interior of the jar, and compromising any vacuum present within the jar. The jar opening aide may be structured as an elongated member having a first end, a middle portion, and a second end. The first end includes a lid engaging portion for contacting and engaging the lower peripheral lip portion of the jar sealing lid, enabling an upward force to be applied for lifting the peripheral lip portion and defeating the seal. A user adjustable fulcrum mechanism, which is coupled to the middle portion, is adjustable by a user so that the jar opening aide may be used with jar sealing lids of differing vertical heights.

24 Claims, 9 Drawing Sheets

12
12a
14
14a
16
18
19
20aa
20b
20c
24
30
60
62
6A
6B
10b

JAR OPENING AIDE WITH ADJUSTMENT FEATURE

TECHNICAL FIELD

The present invention relates most generally to container opening devices and aides. More particularly, the invention relates to a jar opening aide for use with vacuum sealed jars having twist or screw off jar sealing lids.

BACKGROUND ART

Many foods items can be purchased packaged in clear glass and rigid plastic containers that are capped with twist-off sealing lids. Such product containers, which may be generically termed jars, provide for excellent long term storage when the contents placed in the jar are 'vacuum packed'. When an individual wants to access the contents of the jar, a rotational force is applied and the jar sealing lid is twisted-off.

Although a jar and jar sealing lid of this type provides for an excellent, long term, and stable sealing of the contents within the jar, the jar lids can be difficult to initially remove. Interestingly, in most cases it is the vacuum present within the jar, and a downward force applied to the jar sealing lid by the presence of the vacuum, that creates a need for a significant rotational force (or torque) to be applied to the jar sealing lid in order to rotate and twist-off the lid. That is, an individual attempting an opening of vacuum containing jar must simultaneously grasp the jar sealing lid with a first hand and apply a significant rotational force directly to the lid, while also holding the jar firmly with a second hand. In many cases it is difficult, if not impossible, for an individual muster the strength needed to open a vacuum packed jar. This is especially true for aging and physically challenged individuals.

Therefore, skilled persons will appreciate that a releasing of a vacuum established within a jar capped with a jar sealing lid results in a significant reducing of the rotational force and associated torque required to open the jar. A number of known prior art devices are available for releasing a vacuum within a container. A first group of such devices provide what may be termed 'pry-apart' lid openers. Representative devices are taught by the U.S. Patents to Denning (U.S. Pat. No. 5,295,419), Olorenshaw (U.S. Pat. No. 4,881,432), and Smith (U.S. Pat. No. 6,035,508). Each of these devices provides a container or bucket opening device that operates by 'prying apart' a portion of the lid from an upper rim of a container. Accordingly, the containers with which these devices will work must be structured with an external rib or a suitable upper support portion formed upon the container proximate to the lid. In addition, these ribs or support portions must be capable of withstanding significant localized forces without cracking or puncturing. Many of the common jars currently used are simply not be well suited for use with these devices, as they are lacking the rib or upper ledge required.

Another prior art device, which is disclosed in the U.S. Patent to Hermansson (U.S. Pat. No. 5,222,265), is a "combination of a lid prying tool and a cutting edge which provides a safe, easy, efficient method of removing closely fitting lids from buckets by allowing the peripheral skirts of bucket lids to be easily and efficiently cut." The Hermansson device is not intended for use with screw-off lids, and makes no mention of them. In addition, the device taught by Hermansson is not structured to accommodate lids having significantly differing vertical heights.

A number of other prior art devices are available for use in assisting in the opening containers and jars. Some are general purpose in nature, and structured for aiding in the opening a large variety of containers, including cans, bottles and jars. Yet others are arranged for securely grasping circumferential portions of a lid or cap for increasing the torque applied to forcibly twist-off a jar sealing means. However, when considering a simply structured jar opening aide that is usable with jar sealing lids having significantly differing (vertical) heights in order to release a vacuum established within the jar, the prior is silent.

Accordingly, skilled individuals will appreciate a need for a new and or improved jar opening aide, which is structured for use with a variety of jars and jar sealing lids, and which overcomes the limitations and problems of the prior art, including those discussed above. A number of other characteristics, advantages, and or associated novel features of the present invention, will become clear from the description and figures provided herein. Attention is called to the fact, however, that the drawings are illustrative only. In particular, the embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all variations possible are contemplated as being part of the invention, limited only by the scope of the appended claims.

SUMMARY OF THE INVENTION

In accordance with the present invention, a jar opening aide is provided for use with vacuum sealed jars capped with a twist-off or screw-off jar sealing lid. The jar opening aide is preferably structured with a lid engaging portion, a middle portion and a handle portion. The lid engaging portion is located at a first end of the jar opening aide, while the handle portion provides a second end of the jar opening aide. The middle portion, which may be arranged with an adjustable fulcrum mechanism, acts as a structural nexus preferably rigidly coupling the lid engaging portion and the handle portion.

The lid engaging portion is configured for engaging a lower peripheral lip portion of a jar sealing lid. It may be noted that the terms lower lip, lower peripheral lip portion, and peripheral lip portion are to be considered equivalents. Preferable embodiments of the lid engaging portion include a possibly flattened, downwardly extending member. An upper or proximate end of the downwardly extending member is connected or suitably coupled at the first end of the jar opening aide. A lower or distal end of the downwardly extending member is structured with a lip engaging means. For example, contemplated lip engaging means may include an upwardly angled lip engaging tab, or equivalent structures including pegs, pins, etc. Importantly, the lip engaging means provided at the lower or distal end of the downwardly extending member is fixed to the downwardly extending member with an acute angle established between the lip engaging means (tab, peg, etc.) and the downwardly extending member. A preferred range for the acute angle is 40 to 80 degrees, with a possibly most preferred acute angle being substantially 60 degrees.

Typically, once the lid engaging portion engages the lower peripheral lip portion of the jar sealing lid, any required adjusting of the adjustable fulcrum mechanism may be effected. The adjustable fulcrum mechanism would be adjusted to level or align a longitudinal axis of the jar opening aide, as desired by a user. Next, the user securely grasps the handle portion and applies a downward force. The downward force applied to the handle portion causes an upward force to be applied to an engaged lower peripheral lip portion of the jar sealing lid, by way of the adjustable fulcrum mechanism and the lid contacting foot. Fundamentally, a 'lever action' causes the downward force applied to the handle portion to be transformed into an upward force applied to the lower peripheral lip portion of the jar sealing lid via the lid engaging portion. Importantly, the upward force ultimately causes a lifting of the lower peripheral lip portion of the jar sealing lid, defeating a seal established thereat. The defeating of the seal causes a compromising of any vacuum present within the jar, and thereby in the process typically significantly reduces a level of friction that must be overcome for rotating and twisting-off (removing) the jar sealing lid. For example, typically the level of friction is reduced by one-half to one-tenth of an original level of friction. The actual amount of reduction to the level of friction that must be overcome to open a sealed jar in accordance with the invention is determined by the type of lid, along with the lids construction and constituent sealing component(s).

The jar opening aide of the present invention is configured with an adjustable fulcrum mechanism that is most preferably provided at, or coupled to the middle portion. As appreciated by skilled persons, the adjustable fulcrum mechanism may be embodied in a variety of structures. Importantly, the user adjustable fulcrum mechanism is arranged with a lid contacting portion, which may be termed a 'lid contacting foot'. The adjustable fulcrum mechanism enables an adjusting of the distance the lid contacting foot extends below a longitudinal axis of the jar opening aide. The adjusting of this distance enables the jar opening aide of the invention to be utilized with jar sealing lids of significantly differing heights. Specifically, it is contemplated that the structures of the jar opening aide disclosed herein, and equivalents providable by skilled persons, will readily function with jars lids having heights ranging substantially from 5 millimeters to 30 millimeters. However, it must be understood that by adjusting and scaling dimensions of important structures of the jar opening aide disclosed and claimed herein, jars having jar sealing lids of virtually any vertical height may be accommodated.

A simple and low cost construction of the adjustable fulcrum mechanism may be provided by including an elongated threaded member that is substantially orthogonally oriented with respect to the longitudinal axis of the jar opening aide. The elongated threaded member may be arranged for passing downwardly through the middle portion and configured for rotating by the user for moving the lid contacting foot in either of an upward or a downward direction. In order to facilitate the rotating and adjusting of the elongated threaded member, for raising and lowering the lid contacting foot, a torque increasing grasping knob, or an equivalent structure, may be fixed to a first or upper end of the elongated threaded member.

It is important to understand that the jar opening aide of the present invention may be structured as illustrated, in a substantially monolithic construction. Alternately, the present invention may be formed by using separate, joined portions. For example, the lid engaging portion, middle portion, and or handle portion may be constructed of separate and individual pieces, which are coupled or fixed to each other using one or more techniques and or means that are well understood by skilled individuals. However, as will be discussed below and as clearly shown in the included figures, the present invention is preferably constructed such that the lid engaging portion provided at the first end of the jar opening aide may be substantially formed of the same monolithic material that additionally forms portions of the middle portion and possibly the handle portion.

BRIEF DESCRIPTION OF THE DRAWINGS

In the drawings, like elements are assigned like reference numerals. The drawings are not necessarily to scale, with the emphasis instead placed upon the principles and or features of the present invention. Additionally, each of the embodiments depicted are but one of a number of possible arrangements utilizing the fundamental concepts of the present invention. The drawings are briefly described as follows.

Partial List Of Reference Numerals

Figure 1:
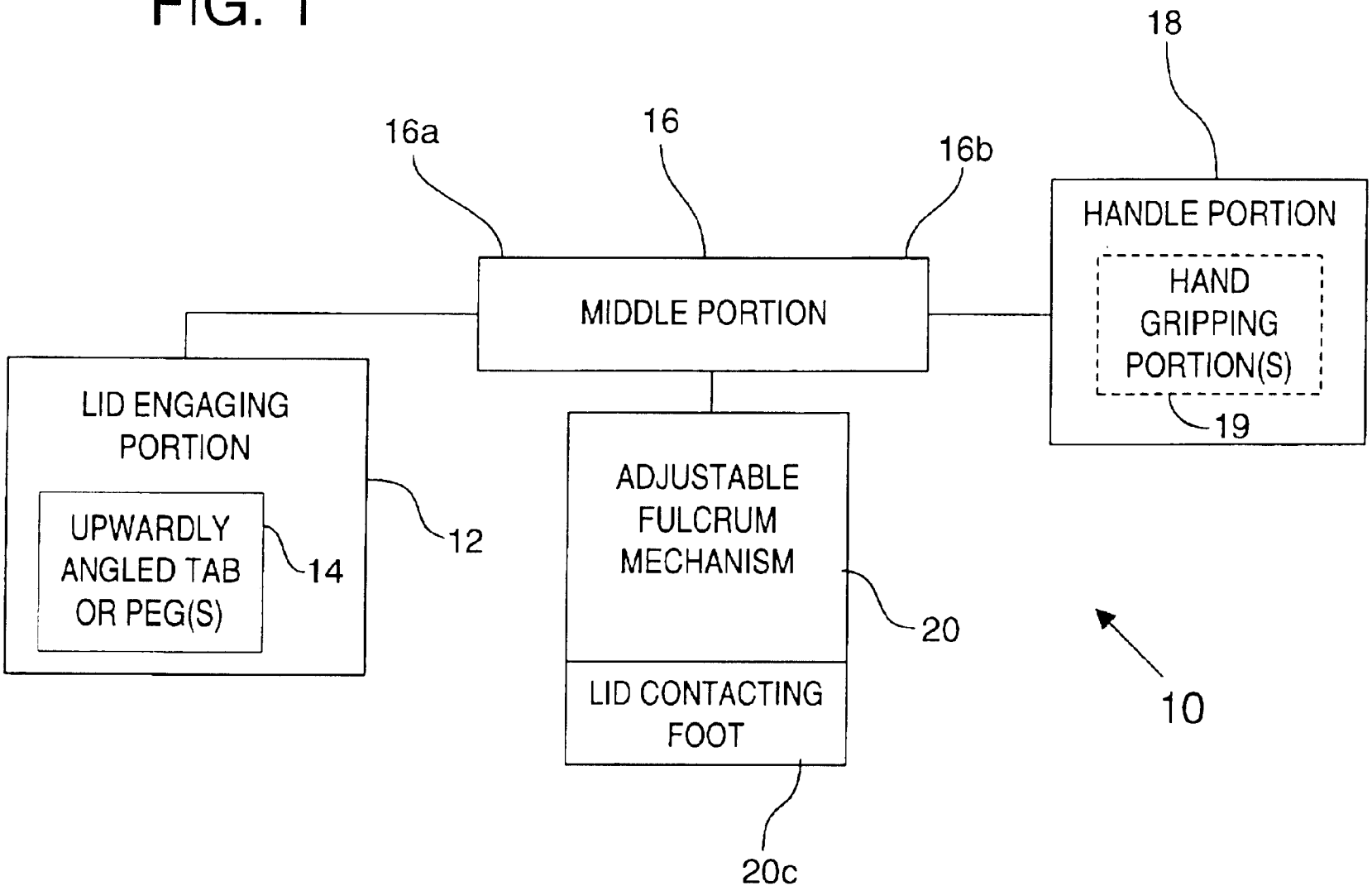
FIG. 1 provides a high level conceptual block diagram of a jar opening aide in accordance with the present invention depicting a plurality of preferred portions, along with their operational and or structural interconnections.

| | |
|---|---|
| 10, 10a, 10b | jar opening aide |
| 12 | lid engaging portion, or first end portion of 10 |
| 12a | downwardly extending member |
| 12aa | first, upper, or proximate end of 12a |
| 12ab | second, lower, or distal end of 12a |
| 14 | lip engaging means |
| 14a | lip engaging tab |
| 16 | middle portion |
| 16a | first end or first end portion of 16 |

-continued

| Partial List Of Reference Numerals | |
|---|---|
| 16b | second end or second end portion of 16 |
| 18 | handle portion or second end (portion) of 10 |
| 19 | hand gripping portion |
| 20 | adjustable fulcrum mechanism |
| 20a | torque increasing means |
| 20aa | alternate torque increasing means, or knob |
| 20b | elongated threaded member |
| 20c | lid contacting foot |
| 24 | horizontal tab of 16 |
| 30 | elongated member |
| 40 | jar |
| 42 | jar sealing lid or lid |
| 42a | lower peripheral lip portion of 42 |
| 42b | top surface of 42 |
| 50 | (user applied) downward force |
| 60 | longitudinal axis of 10, 10a, etc. |
| 62 | bend location or axis |
| 62a | handle bend location |
| 66 | twist or twist portion of 16 |

DETAILED DESCRIPTION AND MODES OF THE INVENTION

It is important to establish the definition and or clear meaning of a number of descriptive terms and expressions that are used throughout this disclosure. The term 'engaging' will be utilized to indicate an effective mechanical contacting of a portion or portions of the present invention and a lower peripheral lip portion of a jar sealing lid, such that a suitable force may be applied thereat, in an upward direction, for lifting that peripheral lip portion of the lid and causing a defeating of a seal formed thereat. For example, a suitable level of upward force for a respective jar sealing lid may be in the range of 5 to 50 pounds, or more. The actual force applied would be related to the actual physical characteristics of a respective jar to be opened. The terms 'upwardly' and 'downwardly' as they are utilized for describing portions of the invention, are to be applied relative to the views and depictions of the preferred embodiments illustrated in FIGS. 1 through 9. Accordingly, a jar and jar opening aide are contemplated as each preferably being in a substantially level orientation when these terms (i.e., upwardly and downwardly) are utilized. The terms 'sure', 'securely', and 'firmly', which may be assumed to be equivalents, will be employed for describing a user grasping the handle portion of the present invention. Additionally, each is intended to indicate that the handle portion is graspable such that when the jar opening aide is employed for engaging and lifting a peripheral lip portion of a jar sealing lid, the jar opening aide will not slip in the hand of the user and, for example, rotate about a longitudinal axis of the device. The terms 'fixed', 'coupled', and 'connected' are to be broadly defined. Each is intended to indicate one of a direct or an indirect physical connecting of two or more items. For example, the connecting of the lid engaging portion 12 and the middle portion 16, may be a seamless mechanical connection established by substantially forming each portion of the same material or piece of material, or alternately by a mechanical coupling of two or more discrete pieces (by way of any well known technique available to skilled persons). The term 'fulcrum' may be assumed to refer to a generalized adjustable structure that may, for example, be provided by the adjustable fulcrum mechanism in accordance with the presently disclosed embodiments of the invention. Finally, it may be assumed that the terms 'lid', 'jar lid', and 'jar sealing lid' are equivalents. Other important terms and definitions will be provided hereinafter, as they are needed, to properly and concisely define the present invention and its associated novel characteristics and features.

Referring now to the drawings, FIG. 1 provides a conceptual high level block diagram of a jar opening aide 10 in accordance with the present invention. As shown the aide 10 includes a lid engaging portion 12, a middle portion 16, and a handle portion 18, which may be substantially formed of an elongated member 30. The lid engaging portion 12 is provided at a first end portion of the jar opening aide 10, and may be termed a distal end of the device. Preferred lid engaging portions 12 include a lip engaging means 14, which is arranged for contacting and engaging the lower peripheral lip, or equivalently a lower peripheral lip portion 42*a* of a jar sealing lid 42 (as can be clearly seen in FIGS. 4 and 8).

Returning to FIG. 1, the lid engaging portion 12 is fixed to or transitions into the middle portion 16. The middle portion 16 is preferably arranged with a first end (portion or region) 16*a*, which is connected to the lid engaging portion 12, and a second end (portion or region) 16*b*, which is connected to the handle portion 18. In most preferred embodiments of the invention the middle portion 16 and the handle portion 18 are each substantially formed by an elongated member 30. Accordingly, the middle portion 16 may be considered a structural nexus for, among other functions, rigidly coupling the lid engaging portion 12 and the handle portion 18. This arrangement, when combined with an adjustable fulcrum mechanism 20 provided at or near the middle portion 16, provides for a lever action available for defeating a seal between a jar sealing lid 42 and a jar 40 to be opened. The adjustable fulcrum mechanism 20 is structured for adjusting by the user. The adjusting is available so that the distance that a lid contacting foot 20*c* of the adjustable fulcrum mechanism 20 extends below a longitudinal axis 60 of the jar opening aide 10. Accordingly, as will be discussed in greater detail hereinafter, a user may easily adjust the jar opening aide 10 of the present invention for use with jars having jar sealing lids 42 of significantly different (vertical) heights. For example, a version of the invention contemplated for use in a common household or commercial kitchens may be embodied to readily accommodate jar sealing lids having heights substantially in the range or 5 to 30 millimeters.

It may also be noted that the middle portion 16 is defined as being located in between the lid engaging portion 12 and the handle portion 18. Importantly, most of the preferred embodiments will not be structured with the middle portion 16 midway or centered with regard to the longitudinal length of the jar opening aide 10. Indeed, in the most preferred embodiments of the present invention the handle portion 18 will provide most of the length of the jar opening aide, as measured along the longitudinal length of the jar opening aide. Importantly, most of the preferred embodiments provide for the locating of the fulcrum at or within the middle portion 16.

Figure 2:
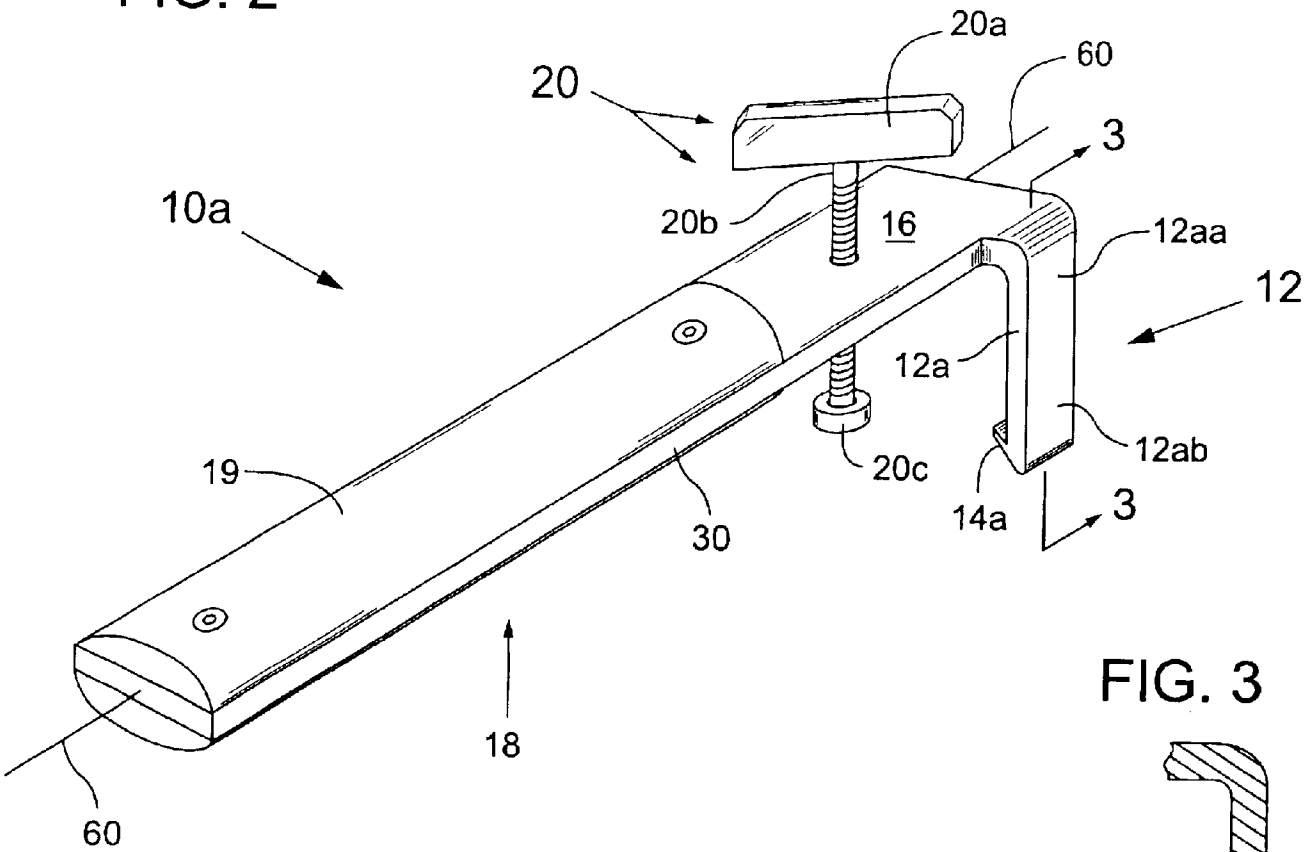
FIG. 2 is an elevated perspective view of a first preferred embodiment of the invention configured with an adjustable fulcrum mechanism.

Turning now to FIG. 2, a perspective view of a first embodiment of a jar opening aide 10*a* is provided. As shown, preferred embodiments of the invention include a lid engaging portion 12 located at a first end of the jar opening aide 10*a*. It may be noted that the first end of each jar opening aide 10 is opposite from the handle or grasping end of the invention, and may be termed a distal end. As clearly seen in FIG. 2, the lid engaging portion 12 is preferably structured with a downwardly extending member 12*a*. The downwardly extending member 12 has a first end 12*aa*, which may be termed a proximate end, and a second, lower end 12*ab*. The downwardly extending member 12*a* is fixed at the first end of the jar opening aide 10*a* and is arranged having an upwardly angled lip engaging means 14 at a lower end thereof. For example, as illustrated in FIG. 2, and possibly best seen in FIGS. 3, 6A, and 6B, the lip engaging means 14 may be structured as an upwardly angled lip engaging tab 14*a* provided at or proximate to the second or lower end 12*ab* of the downwardly extending member 12*a*. As shown in FIG. 4, the lip engaging tab 14*a* is arranged for engaging and lifting a lower peripheral lip portion 42*a* of the jar sealing lid 42, and defeating a seal established between the lid and an upper rim portion of the jar (not explicitly illustrated). The defeating of the seal causing the desired compromising of any vacuum established within the jar 40.

Returning to FIG. 2, the handle portion 18 forms the second end of the jar opening aide 10*a*, and is arranged for sure grasping by a user. One or more hand gripping portions 19, or a number of functional equivalents, may be included when forming the handle portion 18 so as to facilitate sure and secure grasping by a user of the jar opening aide. It may further be noted that the handle portion, and any associated structures such as hand gripping means, may be formed of one or more available materials. For example, a rubberized plastic handle portion may certainly be provided, possibly having textured surfaces, and embodied in any of a variety of opaque and or translucent colors. As depicted in FIG. 2, the handle portion 18 may preferably be provided in the shape of an elongated substantially cylindrical structure with a diameter selected for easy and sure grasping by a hand of the user. A preferred diameter for a handle portion 18 may be substantially in the range of 2 to 3 centimeters. Any structure of a handle portion that enables a user to surely grasp the handle portion, and therefore the jar opening aide, is to be considered within the scope of the present invention.

Located between the lid engaging portion 12 and the handle portion 18 is the middle portion 16 of the jar opening aide 10*a*, which acts as a structural nexus. This is clearly shown in FIG. 2, as well as FIGS. 4, 7, and 9.

Figure 8:
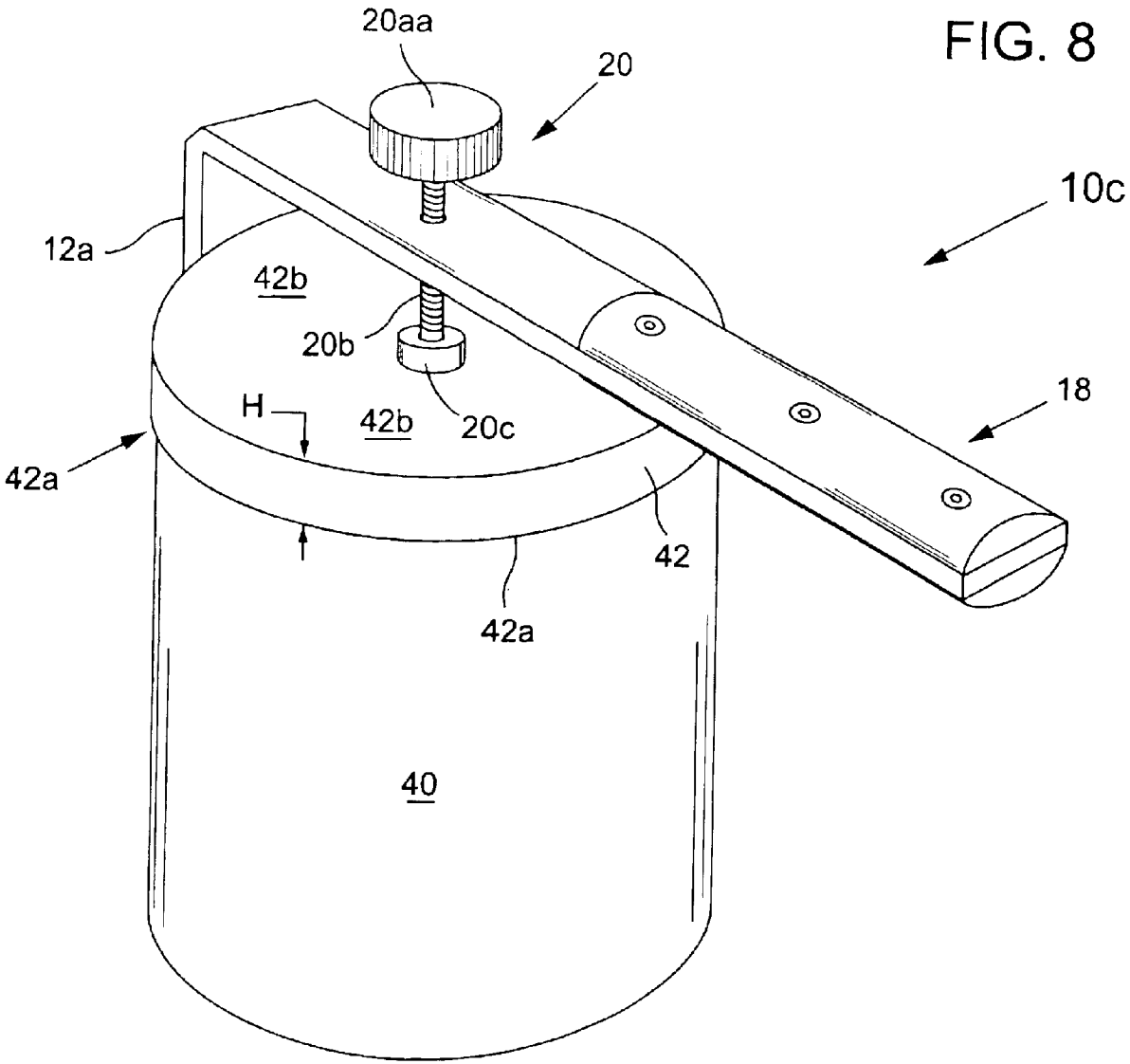
FIG. 8 depicts the embodiment of FIG. 7 engaging a lip portion of the jar sealing lid in accordance with the present invention.

Another feature of preferred embodiments of the jar opening aide of the invention, which is clearly depicted in FIG. 2, is the user adjustable fulcrum mechanism 20. The adjustable fulcrum mechanism 20 is coupled to, or provided at, the middle portion 16, and is available to the user for adjusting a distance a jar lid contacting foot 20*c* extends below a longitudinal axis 60 of the jar opening aide 10*a*. The adjustable fulcrum mechanism 20 is included so that the jar opening aide 10*a* may be utilized with jars having differing jar lid (vertical) heights 'H', as shown in FIG. 8. As can be seen in FIG. 2, preferred embodiments of the adjustable fulcrum mechanism 20 may be structured with an elongated threaded member 20*b*. The elongated threaded member 20*b* may be provided by a threaded rod portion having a first or upper end, and a second or lower end. The elongated threaded member 20*b* is preferably oriented substantially orthogonally with respect to the longitudinal axis 60. As such, the elongated threaded member 20*b* is preferably arranged in a vertical or downwardly extending orientation, passing downwardly through and mating with matching threads of a threaded hole preferably provided in the middle portion 16. Importantly, the elongated threaded member 20*b* is configured for rotating by the user for moving the jar lid contacting foot 20*c* in either of an upward or a downward direction.

Figures 5A, 5B:
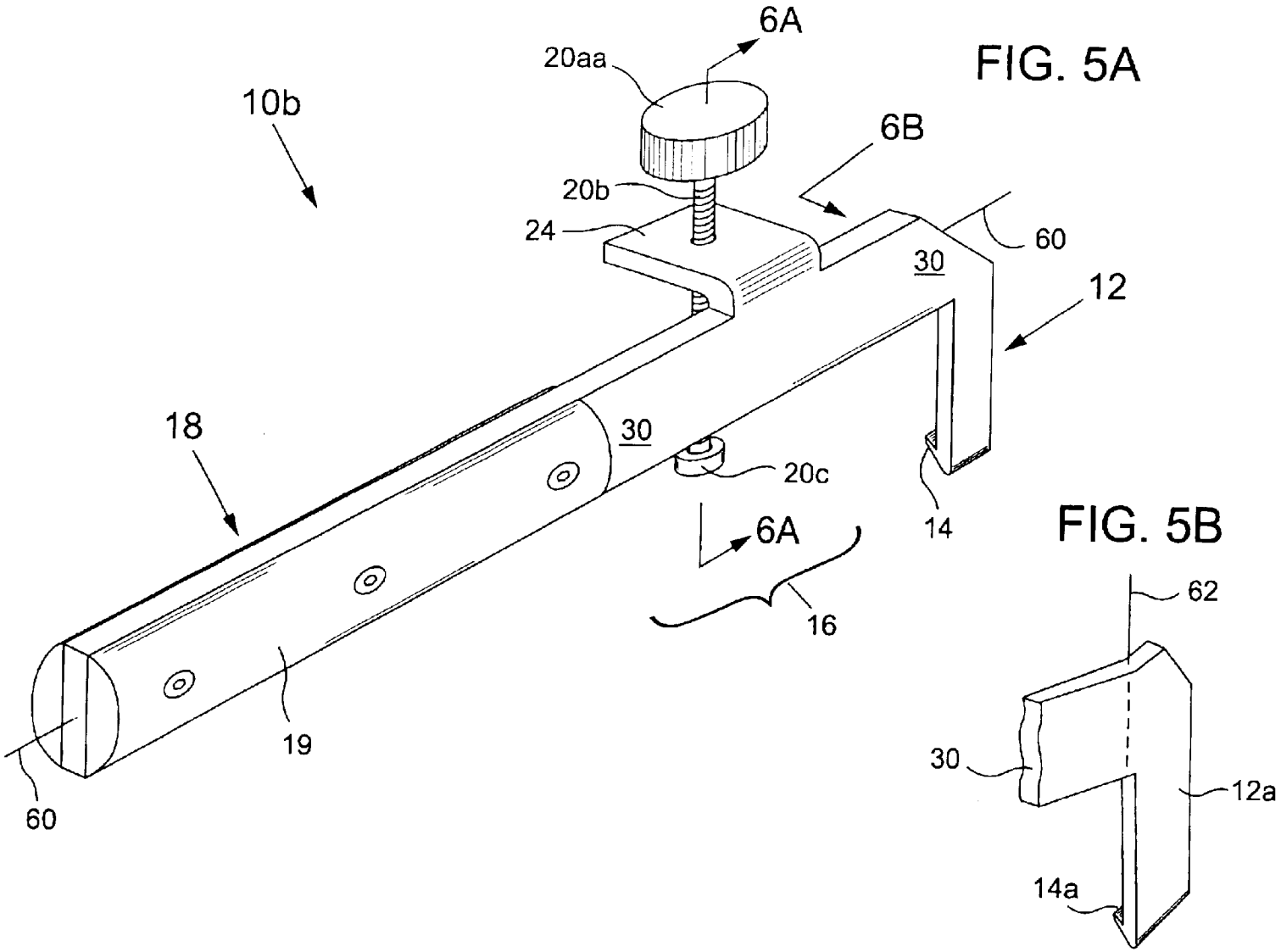
FIG. 5A depicts an alternate embodiment of a jar opening aide of the invention.
FIG. 5B provides a partial perspective view of a downwardly extending member configured in an offset or bent orientation with respect to a longitudinal axis of the jar opening aide.
Figure 6A:
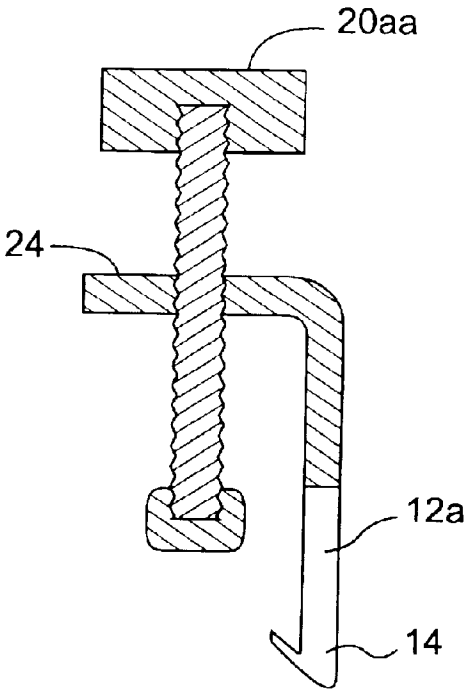
FIG. 6A is a sectional view depicting an adjustable fulcrum mechanism and lid engaging portion, taken along the line 6A—6A of FIG. 5A.
Figure 7:
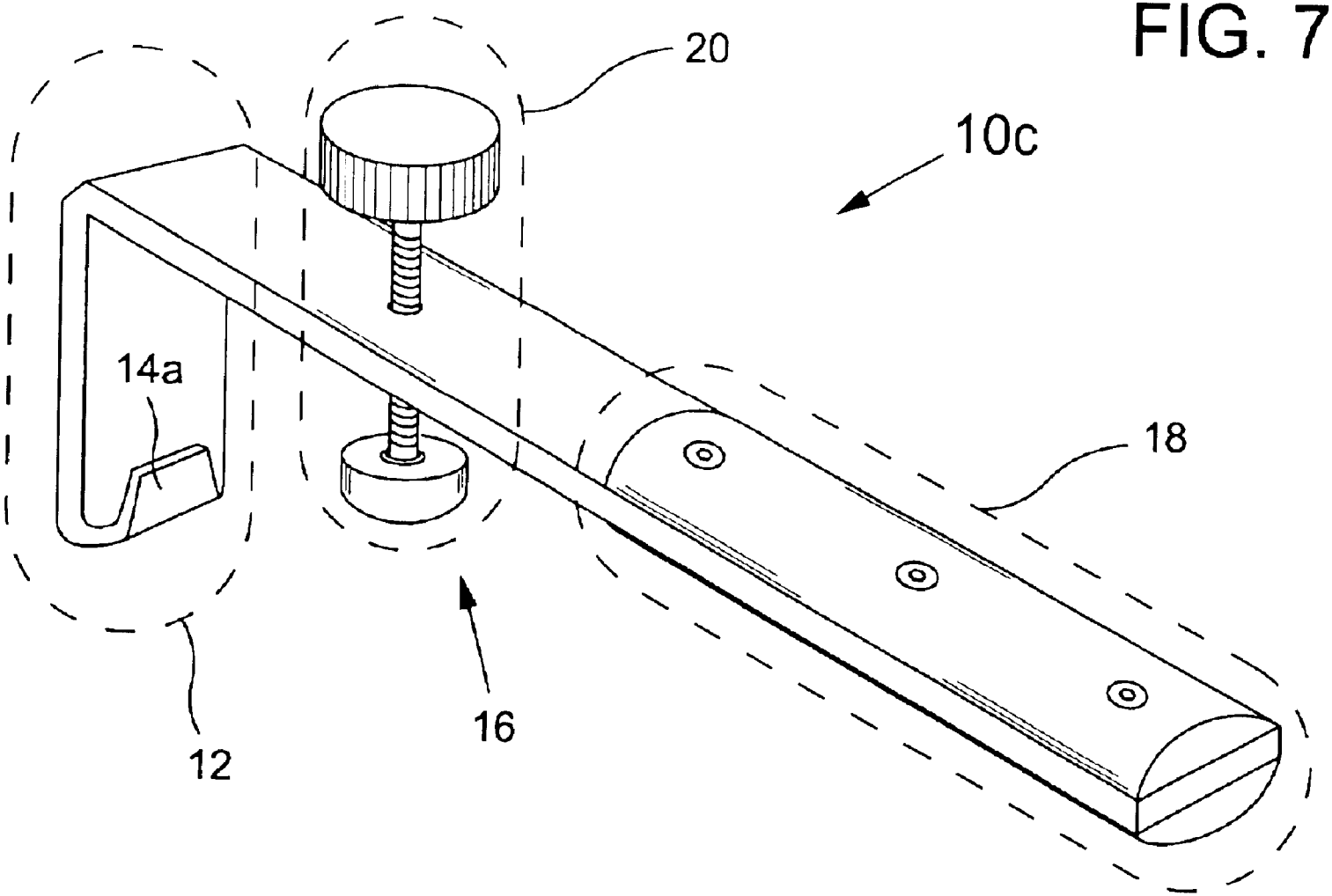
FIG. 7 is an elevated perspective view of yet another embodiment of the jar opening aide.

In order to facilitate the easy rotating of the elongated threaded member 20*b*, a torque increasing means may be fixed to a first end, or equivalently an upper end, of the elongated threaded member 20*b*. For example, as shown in FIG. 2 a torque increasing means 20*a* in the form of a pair of diametrically opposing wing portions may be provided, which extend radially outward from the upper end of the elongated threaded member 20*b*. Other torque increasing means 20*a* may include a knob 20*aa* of a suitable diameter, as depicted in FIGS. 5A, 6A and 7. Skilled persons may certainly provide other suitable torque increasing structures, including disks or jog-wheels (possibly having a finger sized whole).

Figure 3:
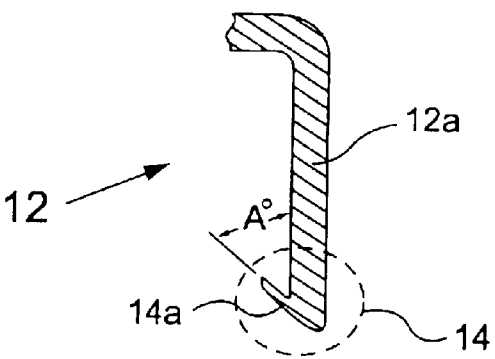
FIG. 3 is a sectional view of a lid engaging portion taken along the line 3—3 of FIG. 2.
Figure 4:
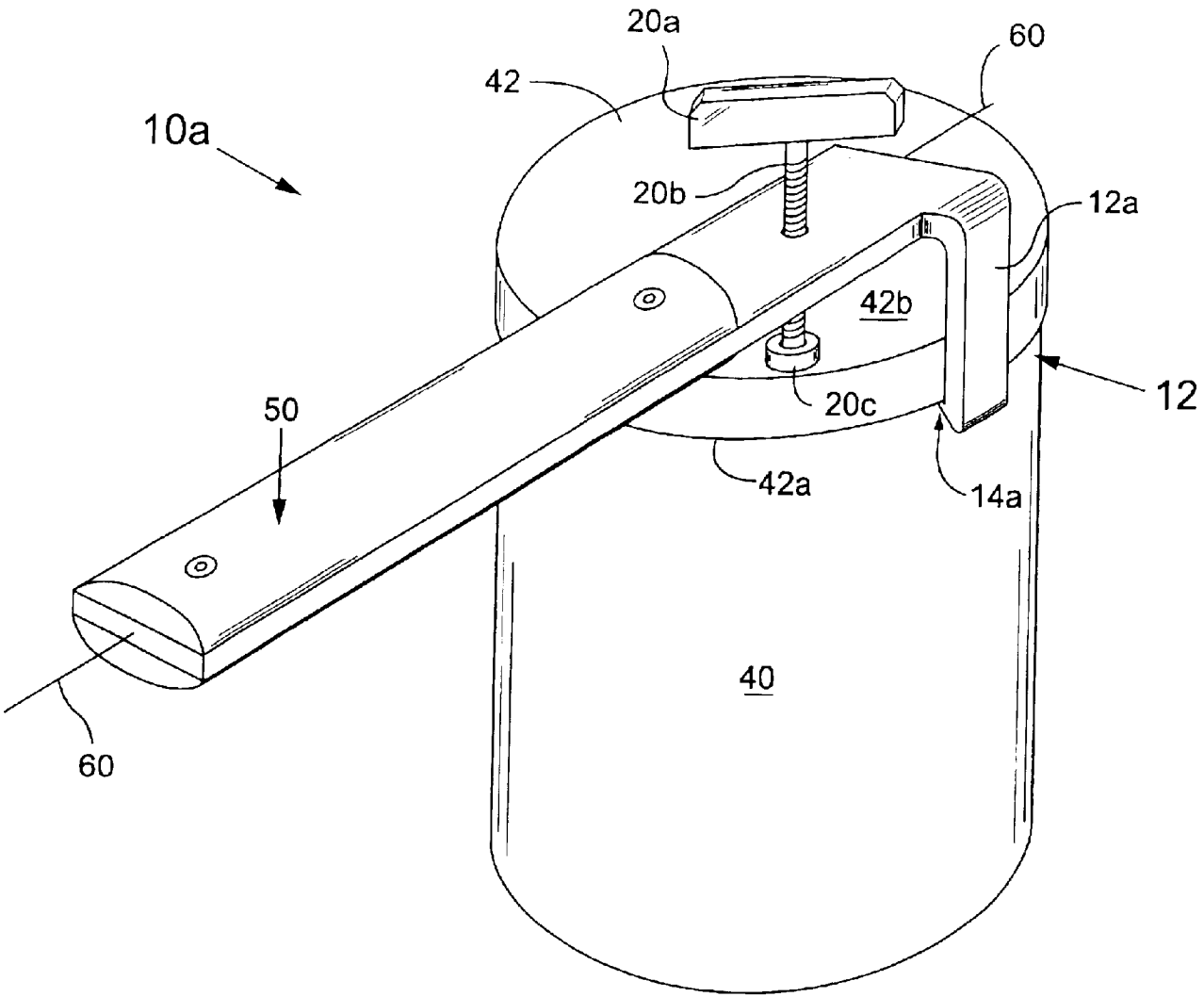
FIG. 4 illustrates the embodiment of FIG. 2 shown engaging a lower peripheral lip portion of a jar sealing lid in accordance with the present invention.

Turning to FIG. 3, a sectional view of the lid engaging portion 12 is provided, taken along the line 3—3 of FIG. 2. As shown, the lip engaging means 14, depicted in a form including a lip engaging tab 14*a*, may be provided at a preferably acute angle 'A'. The acute angle A is measured as the angle between the upwardly angled lip engaging tab 14*a* (or an equivalent structure) and the downwardly extending member 12*a*. Preferred magnitudes for angle A are substantially in the range of 40 to 80 degrees, with a possibly most preferred lip engaging means 14 being provided at an angle of substantially 60 degrees. It is important to note that the actual angle desired may vary with a variety of parameters, including:

a) the scale of the jar opening aide 10 required;

b) the respective construction of the jar sealing lid to be lifted and subsequently unscrewed; and c) the size and thickness of the material employed to form the jar sealing lid.

Referring again to FIG. 4, there is depicted therein an embodiment of the jar opening aide of FIG. 2 engaging a jar 40. As shown, the lid engaging portion 12 is positioned for contacting the lower peripheral lip portion 42*a* of the jar sealing lid 42. The engaging also preferably places the lid contacting foot 20*c* in contact with a top surface 42*b* of the jar sealing lid 42, proximate to each of a rim of the jar and the outer periphery of the jar sealing lid. As such, the lid contacting foot is preferably supported by rim portions that are covered by peripheral surface portions of the jar sealing lid 42. Once engaged as shown in FIG. 4, the user may grasp the handle portion 18 and apply a downward force 50, causing an upward force to be transferred to and applied to the lower peripheral lip portion 42*a* via the lip engaging means 14 (e.g., a lip engaging tab 14*a*). The upward force is applied at a magnitude sufficient for causing a lifting of the lid proximate to the lip engaging means 14. As discussed above, the lifting defeats a seal established between the jar sealing lid 42 and an upper rim portion of the jar 40, causing a compromising of any vacuum established within the jar. The compromising of the vacuum significantly reduces a level of friction that must be overcome for rotating and twisting-off (and removing) the jar sealing lid 42. Further, it is most desirable that the lifting of the lower peripheral lip portion by an embodiment of the jar opening aide not result in a deforming and functional damaging the jar sealing lid 42.

As appreciated by skilled persons, jar opening aides of the invention may be provided in any of a number of alternate constructions. For example, as shown in FIG. 5A yet another substantially monolithic embodiment of a jar opening aide 10*b* of the invention may be provided. This embodiment includes the lid engaging portion 12, a middle portion 16 and a handle portion 18, which function as described hereinabove. However, the middle portion 16 of the embodiment of the jar opening aide 10*b* includes a horizontal tab 24 that extends outwardly from an elongated member 30. The horizontal tab 24 is preferably formed having a threaded hole configured, in like fashion to the embodiment of FIG.

2, for mating with threads of the threaded member 20*b*. This arrangement is possibly best seen in FIG. 6A.

As illustrated in FIG. 5B, an additional feature of the present invention is provided by the inclusion of a "bent orientation" of the downwardly extending member 12*a* (and the lid engaging portion 14 fixed thereto) with respect to the longitudinal axis 60. As shown, a vertical bending axis or simply a bend location 62 may be established by a bending or crooking of the downwardly extending member 12. The bend may be quite modest, say in the range of 5 to 30 degrees as measured horizontally from the longitudinal axis 60. It may be noted that the longitudinal axis 60 is shown and defined in FIGS. 2, 4, and 5A. Alternately, a curved section may be provided, possibly formed as a portion of the downwardly extending member (not illustrated).

In addition, it is contemplated that embodiments of the invention may include one or more possible non-fixed, hinged or rotatable coupling arrangements wherein the lid engaging portion 12 may rotate relative to the middle portion 16. Such an arrangement may enable the user to rotate the downwardly extending member 12*a*, and the lip engaging means 14 fixed thereto, about a bend or vertical axis, such as bend axis 62 of FIG. 5B, so that the horizontal angle measured from a longitudinal axis (such as longitudinal axis 60) to the downwardly extending member 12*a* may be selectively altered, say between a first or minimal angle, and a second or end angle. Accordingly, as the diameter of the jar 40 to be opened varies from jar to jar, the angle of the downwardly extending member 12*a* may be appropriately adjusted. The adjusting of the downwardly extending member 12*a* enables the lip engaging means (e.g., a lip engaging tab 14*a*) to contact and fully engage the lower peripheral lid portion 42*a* in a substantially orthogonal relationship (as viewed looking downwardly from above the lid 42). A preferred minimal angle for rotating the downwardly extending member 12*a* would be near 0 degrees, while a preferred end angle would be substantially in the range of 30 to 45 degrees. Such a non-fixed and rotatable coupling of the downwardly extending member 12*a* to the middle portion 16 may be provided by, for example, a hinge having an elongated hinge pin located substantially at and or parallel to the bend location 62. Skilled persons may provide other structures, including simple riveted arrangements of flattened and overlapping portions formed by each of the downwardly extending member 12*a* and the middle portion 16.

Figure 6B:
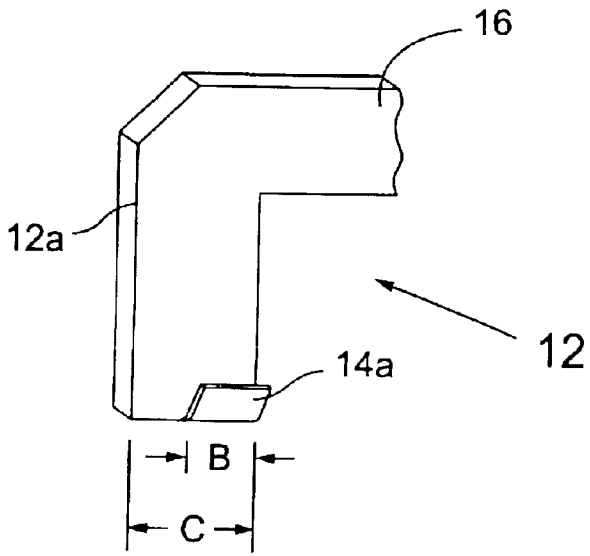
FIG. 6B provides a partial reverse angle view of a lip engaging tab in accordance with the invention taken in the direction of line 6B of FIG. 5A.

A most preferable structure for implementing the lip engaging means 14, as clearly depicted in FIG. 6B, is a lip engaging tab 14*a*. As shown therein the lip engaging tab 14*a* may be provided with an overall width of 'B', which may be a fractional portion of the total width 'C' of the downwardly extending member 12*a*. Alternately, if the material of construction permits, the total width C of 12*a* that is depicted in FIG. 6B may be reduced, and approach or equal the width B of the lip engaging tab 14*a*.

Referring now to FIG. 7, yet another embodiment of the jar opening aide 10*c* of the invention is illustrated. As shown, the jar opening aide 10*c* includes the lid engaging portion 12, the middle portion 16, the adjustable fulcrum mechanism 20, and the handle portion 18. A notable characteristic of the jar opening aide 10*c* of FIG. 7 and FIG. 8 is the contacting of the jar sealing lid 42, by the lid contacting foot 20*c*, in a non-peripheral location. This is best seen in FIG. 8, wherein the lid contacting foot 20*c* contacts the jar sealing lid 42 proximate to a center region of a top surface 42*b* of the lid 42. As such, the embodiment of FIG. 7, may be best constructed with a lid contacting foot 20*c* having a noticeably increased diameter when compared with the lid contacting foot of FIGS. 2 and 5A. The increased diameter provides for the distributing the downward force 50 applied by the adjustable fulcrum mechanism 20 to the middle region of the jar sealing lid 42, so as to not deform or puncture the jar sealing lid 42. Also, it may be most desirable for the lid contacting foot 20*c* to be pivotally and or rotatably coupled to the lower end of the elongated threaded member 20*b*.

Figure 9:
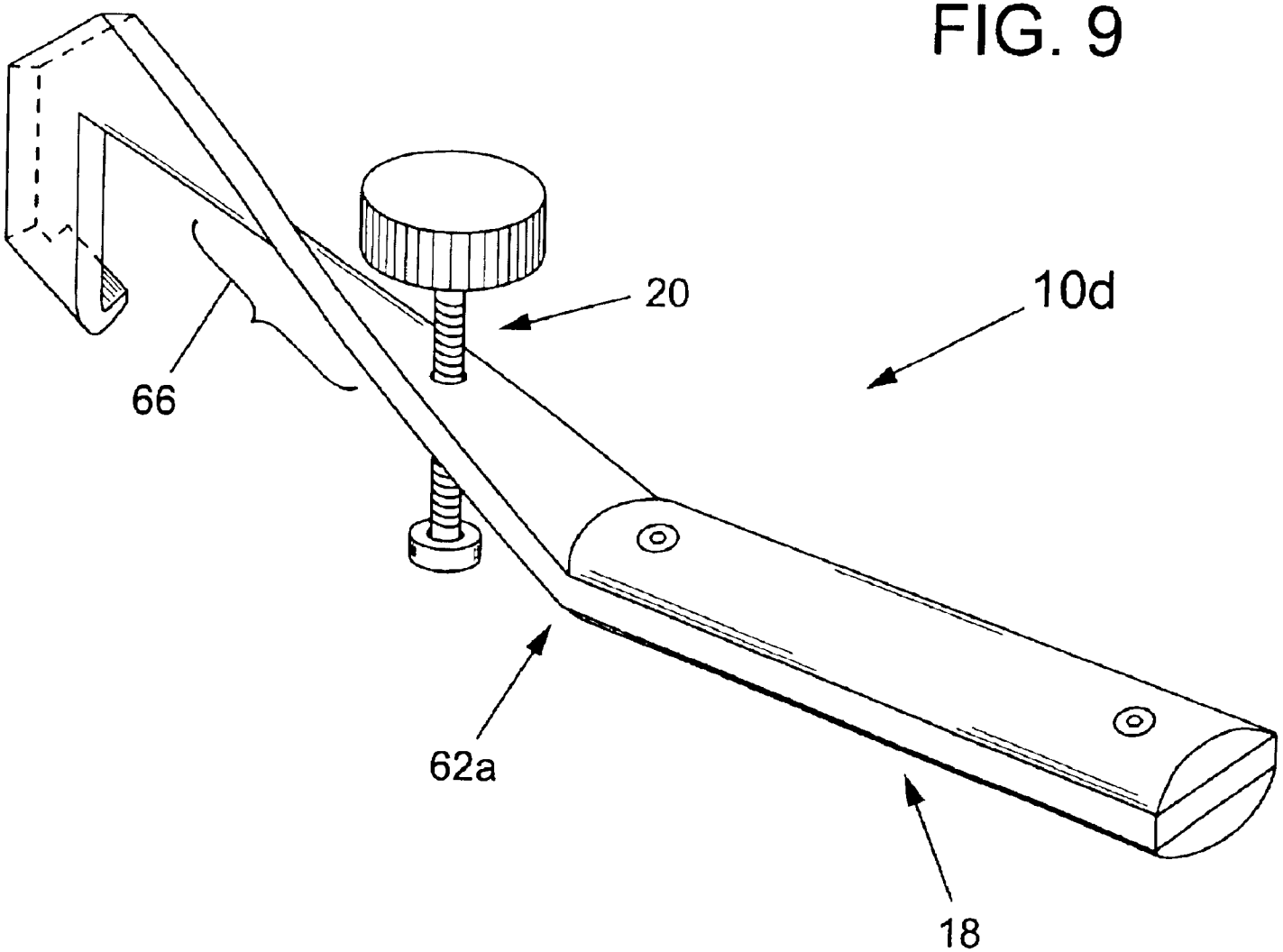
FIG. 9 provides an elevated perspective view of still yet another embodiment of the jar opening aide of the invention.

Referring now to FIG. 9, still yet another embodiment of the invention is provided. The embodiment of FIG. 9 is structured with a middle portion having a twist 66, which among other results, removes the need for a somewhat sharp bend, as included in the embodiments of FIG. 2 and FIG. 4. In addition, it may be desirable to provide a handle portion 18 that is provided in a bent configuration. A bent configuration provides for a bending upwardly (as explicitly depicted in FIG. 9) or downwardly (not illustrated) by including a handle bend location 62*a*. It may be noted that the angle of the handle bend location 62*a* may be more or less than the angle illustrated in FIG. 9, with a preferred angle of bending being substantially in the range of 5 to 40 degrees. Further, it should be understood that a bend such as depicted at the handle bend location 62*a* may be provided with any embodiment of the invention.

Figure 10:
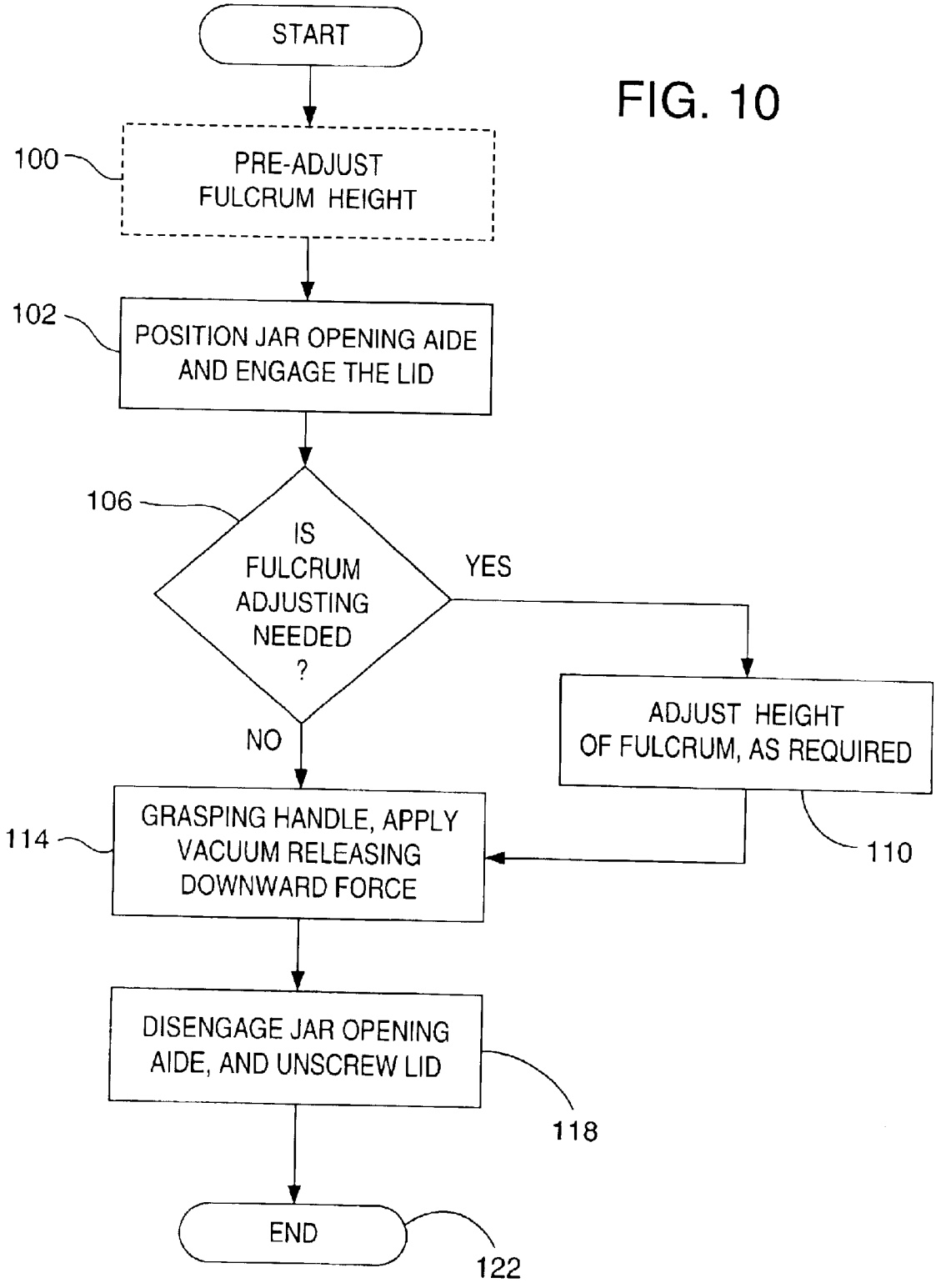
FIG. 10 is a flowchart of a method of engaging, possibly adjusting, and utilizing the present invention for lifting a peripheral lip portion of a twist off jar sealing lid in order to defeat a seal formed by the lid, causing a compromising of a vacuum established within the jar.

Turning now to FIG. 10, a flowchart is provided of a method of employing the jar opening aide of the present invention for aiding in opening a jar. The method provides for an engaging and lifting a peripheral lip portion of a twist-off jar sealing lid (of a jar to be opened) in order to defeat a seal formed by the lid so as to compromise a vacuum established within the jar. As discussed hereinabove, the compromising of any vacuum present within the jar typically significantly reduces a level of friction that must be overcome to twist-off the jar sealing lid. The method may commence, if required, with a pre-adjusting at 100 of the position of the fulcrum height so as to selectively provide an initial locating of the lid contacting foot 20*c* below the longitudinal axis 60 of the invention. At 102, the jar opening aide is positioned so as to engage the jar sealing lid, for example as shown in FIG. 4 and FIG. 8. At 106, a determination is made as to whether further adjusting is necessary (while preferably engaged to the jar to be opened). If further adjustment is required, at 110 a "post-engaging adjusting of the fulcrum" is performed, as required. Subsequent, to any adjusting of the adjustable fulcrum mechanism that may be required, at 114, while the user is surely grasping the handle portion, a downward force is applied. The downward force is transferred to the lid engaging portion via the fulcrum, causing an upward force to be applied to a lower peripheral lip portion 42*a*.

As skilled persons will understand, due to the lever action inherent to the structure of the jar opening aide of the invention, the upward force applied to the lower peripheral lip of the jar sealing lid is significantly greater than the downward force applied by the user. This arrangement thereby minimizes the effort required by the user for causing a lifting of the lower peripheral lip portion of the lid and a defeating of the seal. It may also be noted that the lever action provided by the present invention is quite helpful when the present invention is employed by a physically challenged individual.

Returning to FIG. 10, once a defeating of the seal is realized at 114, and there is a compromising of any vacuum present within the jar, the jar sealing lid may typically be easily rotated. Accordingly, at 118 the user may disengage the jar opening aide and unscrew the twist-off jar sealing lid.

While there have been described herein a plurality of the currently preferred embodiments of a jar opening aide of the present invention, along with contemplated methods of operation and use, those skilled in the art will recognize that other and further modifications may be made without departing from the teachings of the invention. For example, modifications may be made to yield modified structures, which essentially provide for the use of a lever action implement, having an adjustable fulcrum mechanism in accordance with the present invention. Each of these modified embodiments is considered within the scope of the present invention. In addition, skilled persons will appreciate that a number of possible physical and or descriptive modifications are possible. For example, one may provide a description based on a grouping and referring to a middle/nexus portion and the lid engaging portion, as for example, simply a 'distal portion'. Finally, the embodiments of the present invention are illustrated for use and easy grasping by the right hand of a user. Reflected embodiments are certainly providable for easy grasping by the left hand of a user.

Therefore, it should be understood that the foregoing descriptions of the specific embodiments of the present invention have been presented for the purposes of illustration, description, and enablement. They are not intended to be exhaustive or to limit the invention to the specific forms disclosed and or illustrated herein. Obviously numerous other modifications and alterations are possible in light of the above teachings, and it is fully intended to claim all such modifications and variations that fall within the scope of the appended claims provided hereinafter.

What is claimed is:

1. A jar opening aide, comprising:

a) a lid engaging portion;

b) a middle portion fixed to the lid engaging portion;

c) an adjustable fulcrum mechanism coupled to the middle portion and structured with a lid contacting foot, wherein the adjustable fulcrum mechanism is arranged for adjusting by a user to accommodate the use of the jar opening aide with jar sealing lids having varying vertical heights; and d) a handle portion fixed to the middle portion and extending outwardly therefrom in an opposing relationship to the lid engaging portion;

e) the handle portion structured for grasping and enabling a user to apply a downward force, while the lid engaging portion is engaging a jar sealing lid, causing an upward force to be applied to a lower peripheral lip portion of the jar sealing lid, defeating a seal established between the lid and an upper rim portion of the jar, compromising any vacuum present within the jar, and thereby reducing a level of friction that must be overcome for rotating and twisting-off the jar sealing lid.

2. The jar opening aide in accordance with claim 1, wherein the lid contacting foot contacts a top surface of the jar sealing lid proximate to each of the rim of the jar and an outer periphery of the jar sealing lid.

3. The jar opening aide in accordance with claim 1, wherein the lid engaging portion includes a downwardly extending member connected at a first end of the jar opening aide, the downwardly extending member substantially vertically oriented and structured with a lip engaging means at a lower end thereof.

4. The jar opening aide in accordance with claim 3, wherein the lip engaging means includes a lip engaging tab that is upwardly angled with an acute angle established between the downwardly extending member and the lip engaging tab being substantially in the range of 40 to 80 degrees.

5. The jar opening aide in accordance with claim 4, wherein the lip engaging tab is fixed to the downwardly extending member at an angle of substantially 60 degrees.

6. The jar opening aide in accordance with claim 1, wherein the adjustable fulcrum mechanism includes an elongated threaded member that mates with a matching threaded hole formed in the middle portion, with a lower end of the elongated threaded member coupled to the lid contacting foot.

7. The jar opening aide in accordance with claim 6, wherein the lid contacting foot is pivotally coupled to the lower end of the elongated threaded member.

8. The jar opening aide in accordance with claim 6, wherein the handle portion is oriented in a bent configuration with regard to a longitudinal axis passing through the lid engaging portion and the middle portion.

9. The jar opening aide in accordance with claim 1, wherein a bend location provides for a bent orientation of the lid engaging portion with respect to a longitudinal axis of the jar opening aide.

10. The jar opening aide in accordance with claim 9, wherein a bend provided at the bend location is at a selected angle substantially in the range of 5 to 30 degrees.

11. The jar opening aide in accordance with claim 9, wherein a bent orientation of the lid engaging portion with respect to the longitudinal axis is provided by a curved portion provided proximate to a transitioning from the middle portion to the lid engaging portion.

12. A jar opening aide employing a lever action for applying an upward force to a lower peripheral lip portion of a twist-off jar sealing lid employed for sealing a jar, with the applying of the upward force causing a defeating of a seal and a compromising of a vacuum established within the jar, and thereby reducing a level of friction that must be overcome for rotating and twisting-off the jar sealing lid, the jar opening aide comprising:

a) a lid engaging portion located at a first end of the jar opening aide;

b) the lid engaging portion structured with a downwardly extending member arranged having an upwardly angled lip engaging tab located at a lower end thereof, the lip engaging tab arranged for engaging and lifting the lower peripheral lip portion of the lid, causing a defeating of a seal established between the lid and an upper rim portion of the jar, compromising any vacuum established within the jar;

c) a handle portion forming a second end of the jar opening aide and arranged for grasping by a user; and d) a middle portion of the jar opening aide provided between and coupling the lid engaging portion and the handle portion;

e) a user adjustable fulcrum mechanism coupled to the middle portion and available for adjusting a distance a lid contacting foot extends below a longitudinal axis of the jar opening aide for accommodating respective jar sealing lids having differing heights;

f) the lid engaging portion arranged for contacting the lower peripheral lip portion of the lid and enabling the upward force to be applied to the lid via the lip engaging tab, wherein the upward force is generated by a downward force applied to the handle portion by the user, causing the defeating of the seal established between the lid and an upper rim portion of the jar, thereby compromising any vacuum established within the jar and reducing a level of friction that must be overcome for rotating and twisting-off the jar sealing lid.

13. The jar opening aide in accordance with claim 12, wherein the adjustable fulcrum mechanism includes an elongated threaded member, that is substantially orthogonally oriented with respect to a longitudinal axis, and arranged passing downwardly through the middle portion and configured for rotating by the user for moving the lid contacting foot in either of an upward and a downward direction.

14. The jar opening aide in accordance with claim 13, wherein an upper end of the elongated threaded member is arranged with having fixed thereto one of:

a) a grasping knob; and b) a pair of diametrically opposing wing portions coupled to and extending radially outwardly from the elongated threaded member.

15. The jar opening aide in accordance with claim 14, wherein the handle portion is arranged having a substantially cylindrical shape with a diameter selected for firm grasping by a hand of the user for facilitating the applying of the downward force.

16. The jar opening aide in accordance with claim 12, wherein the upwardly angled lip engaging tab of the lid engaging portion is constructed with an acute angle established between the downwardly extending member and the lip engaging tab being substantially in the range of 40 to 80 degrees.

17. The jar opening aide in accordance with claim 16, wherein the lip engaging tab is fixed to the downwardly extending member at an acute angle of substantially 60 degrees.

18. The jar opening aide in accordance with claim 12, wherein the middle portion includes one of:

a) a horizontal tab that extends outwardly from portions of the middle portion, with the tab having formed therein a threaded hole configured for mating with threads of the elongated threaded member; and b) a flat centered portion having formed therein the threaded hole configured for mating with threads of the elongated threaded member.

19. A jar opening aide structured for lifting a lower peripheral lip portion of a screw-on jar sealing lid defeating a seal formed between an inner surface of the lid and an upper rim of the jar, the defeating of the seal and compromising of any vacuum established within the jar causing a reducing of a level of friction associated with the seal, and thereby reducing the force needed for rotating and twisting-off the jar sealing lid to open the jar, the jar opening aide comprising:

a) an elongated member having a first end, a middle portion, and a second end;

b) the first end structured with a lid engaging portion for contacting and engaging an underside of the peripheral lip portion of the jar sealing lid, enabling an upward force to be applied for lifting the peripheral lip portion;

c) the middle portion of the jar opening aide is coupled to a user adjustable fulcrum mechanism available for adjusting a distance a lid contacting foot of the adjustable fulcrum mechanism extends below a longitudinal axis of the elongated member of the jar opening aide, enabling the jar opening aide to be used with jar sealing lids of differing heights; and d) the second end arranged providing a handle portion for grasping by the user for applying a downward force, which is coupled to the lip engaging portion via the middle portion and the adjustable fulcrum, causing an applying of the upward force to the lower peripheral lip portion of the lid, lifting the lower peripheral lip portion and the defeating of the seal, compromising any vacuum established within the jar;

e) the compromising of the vacuum causing the reducing of the level of friction associated with the seal, and thereby reducing the force needed to rotate and remove the twist-off the jar sealing lid from the jar.

20. The jar opening aide in accordance with claim 19, wherein the lid engaging portion is structured with a downwardly extending member arranged having an upwardly angled lip engaging means.

21. The jar opening aide in accordance with claim 20, wherein the upwardly angled lip engaging means is provided by at least one of:

a) an inwardly and upwardly projecting tab located at a lower end of the downwardly extending member; and b) at least one peg extending inwardly and upwardly from the lower end of the downwardly extending member.

22. The jar opening aide in accordance with claim 19, wherein the adjustable fulcrum mechanism includes an elongated threaded member passing through the middle portion and configured for rotating by the user for moving the lid contacting foot in either of an upward and downward direction to accommodate lids of differing heights, along with at least one of:

a) a torque increasing grasping knob; and b) a torque increasing pair of diametrically opposing wing portions extending radially outwardly from the elongated threaded member;

c) with either of the grasping knob and the wing portions fixed to an upper end of the elongated threaded member opposite to the end configured with the lid contacting foot.

23. A method of employing a jar opening aide structured with a lid engaging portion enabling an upward force to be applied to a lower peripheral lip portion of a jar sealing lid for causing a defeating of a seal formed between an inner surface of the jar sealing lid and an upper rim of a jar to be opened, the method including the steps of:

a) positioning the jar opening aide so as to engage the lower peripheral lip portion of the jar sealing lid of the jar to be opened;

b) adjusting an adjustable fulcrum mechanism of the jar opening aide to accommodate the vertical height of the jar sealing lid, as required;

c) grasping the handle of the jar opening aide and applying a downward force to the handle, causing by way of a lever action, an upward force to be applied to the lid engaging portion for lifting the lower peripheral lip portion of the jar sealing lid, causing a defeating of a seal formed between an inner surface of the lid and an upper rim of the jar, resulting in a compromising of a vacuum established within the jar and thereby causing a reducing of a level of friction associated with the seal that must be overcome for rotating and twisting-off the jar sealing lid;

d) disengaging the jar opening aide from the jar; and e) rotating and twisting-off the jar sealing lid to open the jar.

24. The method recited in claim 23, further including a step wherein the user pre-adjusts the adjustable fulcrum mechanism prior to the step of positioning jar opening aide so as to engage the lid.

* * * * *